US009464392B2

(12) United States Patent
Teich

(10) Patent No.: US 9,464,392 B2
(45) Date of Patent: Oct. 11, 2016

(54) BATTERY OPERATED PARKING BARRIER

(71) Applicant: Rudor Teich, West Orange, NJ (US)

(72) Inventor: Rudor Teich, West Orange, NJ (US)

( * ) Notice: Subject to any disclaimer, the term of this patent is extended or adjusted under 35 U.S.C. 154(b) by 81 days.

(21) Appl. No.: 14/549,674

(22) Filed: Nov. 21, 2014

(65) Prior Publication Data

US 2016/0145817 A1 May 26, 2016

(51) Int. Cl.
*E01F 13/08* (2006.01)

(52) U.S. Cl.
CPC ..... *E01F 13/085* (2013.01)

(58) Field of Classification Search
CPC ..... E01F 13/042; E01F 13/06; E01F 13/065; E01F 13/00; E01F 13/085; G07F 17/244
See application file for complete search history.

(56) References Cited

U.S. PATENT DOCUMENTS 2,488,313 A * 11/1949 Miskelly ..... B61L 29/243 188/185
2,505,940 A * 5/1950 Bone ..... B61L 29/243 188/187
3,849,936 A * 11/1974 Geraci ..... E01F 13/085 49/35
3,948,375 A * 4/1976 Selby, Jr. ..... G07F 17/244 194/216
4,822,206 A * 4/1989 Roussel ..... E01F 13/085 404/10
6,025,663 A * 2/2000 Hull ..... E05F 15/603 310/75 R
6,150,958 A * 11/2000 Worsham ..... E01F 13/085 340/932.2
7,001,099 B2 * 2/2006 Rittenhouse ..... E01F 13/08 404/6
8,618,906 B2 * 12/2013 Al-Jafar ..... E01F 13/085 340/435
8,678,701 B1 * 3/2014 Aldasem ..... E01F 13/08 256/13.1
8,794,866 B2 * 8/2014 Petryshyn ..... E01F 13/085 404/10
2002/0162276 A1 * 11/2002 Biton ..... E01F 13/085 49/49

FOREIGN PATENT DOCUMENTS

FR 2532985 A1 * 3/1984 ..... E06B 11/085

* cited by examiner

*Primary Examiner* — Abigail A Risic
(74) *Attorney, Agent, or Firm* — Michael J. Feigin, Esq.; Feigin & Fridman

(57) ABSTRACT

A battery operated parking barrier which is directly driven by a motor between a blocking position and an open position, and a drive shaft which may be locked to resist external forces in the blocking position and in the open position.

19 Claims, 8 Drawing Sheets

BATTERY OPERATED PARKING BARRIER

BACKGROUND OF THE DISCLOSED TECHNOLOGY

Parking spaces and/or driveways often include a barrier or bollard so as to selectively bar entrance of vehicles to the parking space or driveway. Typically, such barriers may be controlled remotely, for example from within a vehicle, and move from one stable position to another stable position when a suitable command is received via a signal from the remote control source.

For a parking barrier to be effective, it must offer resistance against external forces that may try to push the barrier down to facilitate unauthorized access to the parking space. Numerous ways have been suggested for providing such resistance, however most of them result in excessive power loss or wear of the motor and parts of the barrier, making them inefficient, particularly when the barrier is battery operated.

While the barrier needs to offer resistance to external forces, it also needs to yield to excessive forces else the barrier and its mounting may become irrevocably damaged. It is known in the art that barriers can be provided with a defense against physical abuse. Some such defense mechanisms include the use of external compression springs as structural elements of a barrier, the use of internal compression springs disposed within the barrier and driven by a cam, or the use of a friction clutch. However, each of these mechanisms suffers from at least one crucial disadvantage.

External compression springs bend in a large radius, such that if a vehicle forces its way over the barrier, the barrier and/or the undercarriage of the vehicle are likely to be damaged. Cam driven defenses cause excessive friction. Such friction resists rotation when the defense returns the barrier to its blocking position, and reduces the torque available for raising the barrier, often leaving the barrier in an interim position between the blocking position and an open position. Friction clutches, which may be included in some defense mechanisms, present their largest resistance when first pushed, but drop the resistance level as the friction coefficient changes from static to dynamic. As such, once the friction clutch starts to yield, it can readily be pushed all the way to the ground.

For example, in PCT Patent Application Publication WO 2009/019171 to Ducati, a motor driven barrier including a worm gear is disposed between the motor and the barrier shaft, thus preventing the barrier from being forced from its upright position. However, the disclosed worm gear is inherently inefficient and causes a significant loss of the power, which highly degrades the lifetime of the battery in a battery operated system.

Further, U.S. Pat. No. 4,535,974 to Conde discloses use of external compression springs as structural elements of a barrier, such that the springs form the upright section of the barrier. When impacted, the springs bend and yield, and return to their original position when the external force is removed.

There is thus a long felt need in the art for a barrier system that provides a defense against physical abuse, which defense is self-sufficient, offers increasing resistance as the barrier is pushed down, reliably returns the barrier to its blocking position, and does not require use of battery power to return the barrier to the blocking position.

SUMMARY OF THE DISCLOSED TECHNOLOGY

The disclosed technology described herein addresses a need, unfulfilled in the prior art, for a battery powered remote controlled vehicle barrier including a defense against abuse. There is further a need for such a barrier to minimize mechanical failure, damage to an impacting vehicle, and moves effectively between an open position and a blocking position for as many open/block cycles as possible, while running on a battery.

There is thus provided in accordance with an embodiment of the disclosed technology a barrier, comprising a rotatable blocking arch, stable in a first, blocking position, and in a second, open position, a rotatable shaft, functionally connected to the blocking arch, rotating the arch between the first and second positions, an electric motor, functionally associated with the rotatable shaft, providing driving power to the shaft for rotation thereof, a power source providing power to the electric motor, and a brake portion, slidably mounted on the shaft and actuated by the electric motor, the brake portion locking the shaft to external forces when the shaft is in a position corresponding to one of the blocking position and the open position of the arch.

In some embodiments, the electric motor, the shaft, and the brake portion are aligned along a horizontal line extending between ends of the arch.

In some embodiments, the brake portion locking the shaft prevents the shaft from rotating such that there is no measurable degree of freedom for rotation of the shaft.

In some embodiments, the barrier further comprises a cam disposed on the shaft and rotatable therewith and engaging the motor, the cam transferring rotational force from the motor to the shaft.

In some embodiments, at a start of rotation of the motor, corresponding rotation of the cam causes the cam to activate the brake portion by engaging at least one surface of the brake portion and pushing the brake portion into an unlocking position wherein the shaft is free to rotate under force of the motor. In some embodiments, at a start of rotation of the motor, the motor rotates without driving corresponding rotation of the shaft.

In some embodiments, the barrier further comprises a locking pin mounted onto the shaft, wherein when the shaft is in a position corresponding to the open position or to the blocking of the arch, the locking pin engages a cavity of the brake portion, thereby defining a locking position of the brake portion and blocking rotation of the shaft.

In some embodiments, during rotation of the shaft the brake portion is prevented from returning to the locking position by the locking pin being unaligned with the cavity of the brake portion.

In some embodiments, the brake portion moves between a locking position and an unlocking position thereof regardless of the direction of rotation of the motor.

In some embodiments, the barrier further comprises a defense assembly including a spring and at least one link connecting the rotatable shaft to the rotatable arch, the link being free to move within an arc perpendicular to the shaft and being under pull tension from the spring, wherein movement of the link allows the arch to rotate relative to the shaft when rotational force exceeding a retaining force generated by the spring is applied to the arch from an external force.

In some embodiments, the spring is contained within the arch. In some embodiments, the pull tension applied by the spring forces the arch to return to a pre-forced position once the external force has been removed.

In some embodiments, the defense assembly comprises two links connecting the rotatable shaft to the rotatable arch, a first of the two links being free to move within an arc perpendicular to the shaft in a first direction, and a second of the two links being free to move within an arc perpendicular to the shaft in a second direction opposite to the first direction, wherein the two links allow the arch to rotate relative to the shaft when rotational force exceeding a retaining force generated by the spring is applied to the arch from an external force in the first or in the second direction.

There is also provided in accordance with another embodiment of the disclosed technology a barrier, comprising a rotatable blocking arch, stable in a first, blocking position, and in a second, open position, a rotatable shaft, functionally connected to the blocking arch, rotating the arch between the first and second positions, a defense assembly comprising a spring and at least one link connecting the rotatable shaft to the rotatable arch, the link being free to move within an arc perpendicular to the shaft and being under pull tension from the spring, wherein movement of the link allows the arch to rotate relative to the shaft when rotational force exceeding a retaining force generated by the spring is applied to the arch from an external force.

In some embodiments, the spring is contained within the arch. In some embodiments, the pull tension applied by the spring forces the arch to return to a pre-forced position once the external force has been removed.

In some embodiments, the defense assembly comprises two links connecting the rotatable shaft to the rotatable arch, a first of the two links being free to move within an arc perpendicular to the shaft in a first direction, and a second of the two links being free to move within an arc perpendicular to the shaft in a second direction opposite to the first direction, wherein the two links allow the arch to rotate relative to the shaft when rotational force exceeding a retaining force generated by the spring is applied to the arch from an external force in the first or in the second direction.

In some embodiments, the defense assembly further comprises at least two planar discs including concentric slots mounted onto the shaft, and wherein the at least one link is movably attached to the concentric slots in the planar discs.

In some embodiments, the spring comprises a Polyurethane spring. In some embodiments, the spring comprises a gas spring including internal damping.

"Substantially" for purposes of this disclosure, is defined as a minimal amount within an acceptable tolerance level known in the art, such as the function modified by the word is considered to be carried out by an ordinary observer in the field, such as greater than 95% of what is desired. It should be understood that any term in this disclosure can be understood by it's literal meaning, or can be modified by the term "substantially" if written as such in the claims.

DETAILED DESCRIPTION OF EMBODIMENTS OF THE DISCLOSED TECHNOLOGY

The presently disclosed technology is directed towards a battery operated parking barrier which is driven by a motor between a blocking position and an open position, and a drive shaft which may be locked to resist external forces in the blocking position and in the open position.

Figure 1A:
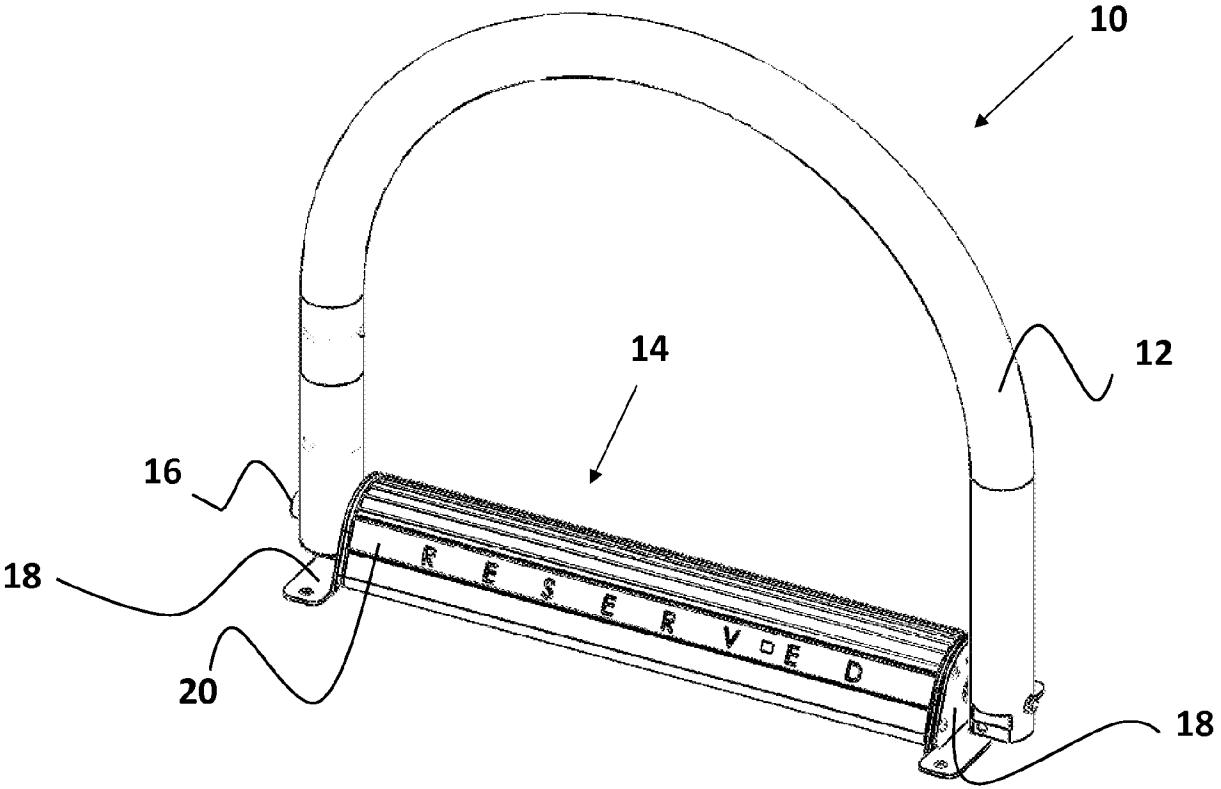
FIGS. 1A and 1B show perspective views of a parking barrier according to the disclosed technology, in a blocking position and an open position, respectively.
Figure 1B:
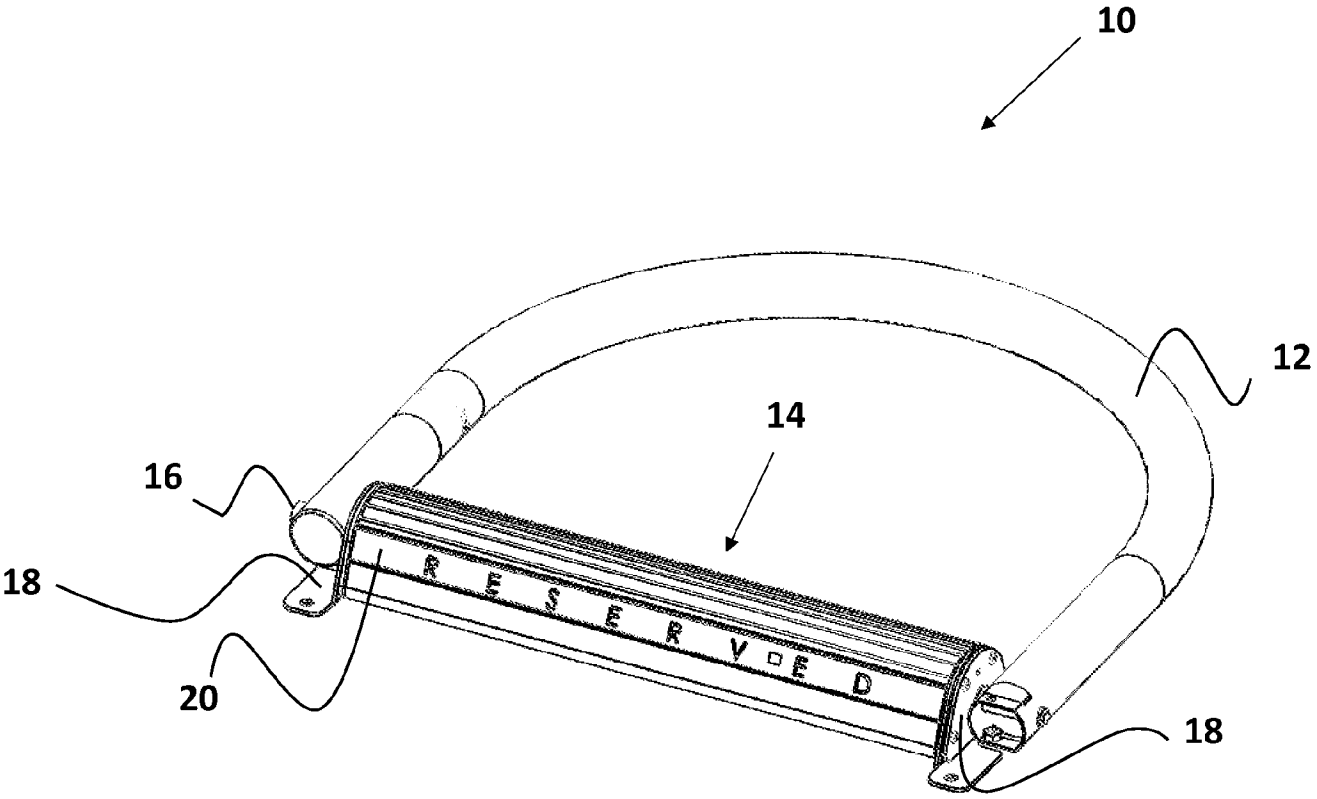

FIGS. 1A and 1B show perspective views of a parking barrier 10 according to the disclosed technology, in a blocking position and an open position, respectively. The parking barrier 10 comprises a blocking arch 12, connected to a rotatable shaft 16 disposed within a base 14. Base 14 is connectable to a floor or street surface, for example by mounting brackets 18, and includes a housing 20 that covers and protects the internal mechanisms, such as the power source and the driving assembly, as described hereinbelow. As explained hereinbelow, in some embodiments, the mechanism for operating barrier 10 is disposed within base 14. In some embodiments, housing 20 of base 14 may include a message, such as "reserved", or an indication as to the permitted users of the protected driveway or parking space, such as a license plate number of a permitted vehicle.

FIG. 1A shows barrier 10 in a blocking position, in which blocking arch 12 is upright and is disposed vertically generally perpendicular to a surface onto which base 14 is mounted. In this position, blocking arch 12 prevents vehicles from entering a barred parking space or driveway. FIG. 1B shows barrier 10 in an open position, in which blocking arch 12 lies flat and is disposed horizontally, generally parallel to the surface onto which base 14 is mounted. In this position, any vehicle may drive over base 14 and arch 12, and enter the corresponding driveway or parking space.

As explained hereinbelow, barrier 10 includes a signal receiver (not shown), which in some embodiments is incorporated into a PCB assembly as described hereinbelow, configured to receive a signal from a remote source, such as a remote control transmitter (not shown), and to move the barrier 10 between the blocking position and the open position in response to the received signal, as known in the art. The barrier is moved between the blocking position and the open position by rotating the shaft 16, and thereby rotating arch 12 with respect to base 14.

Figure 2:
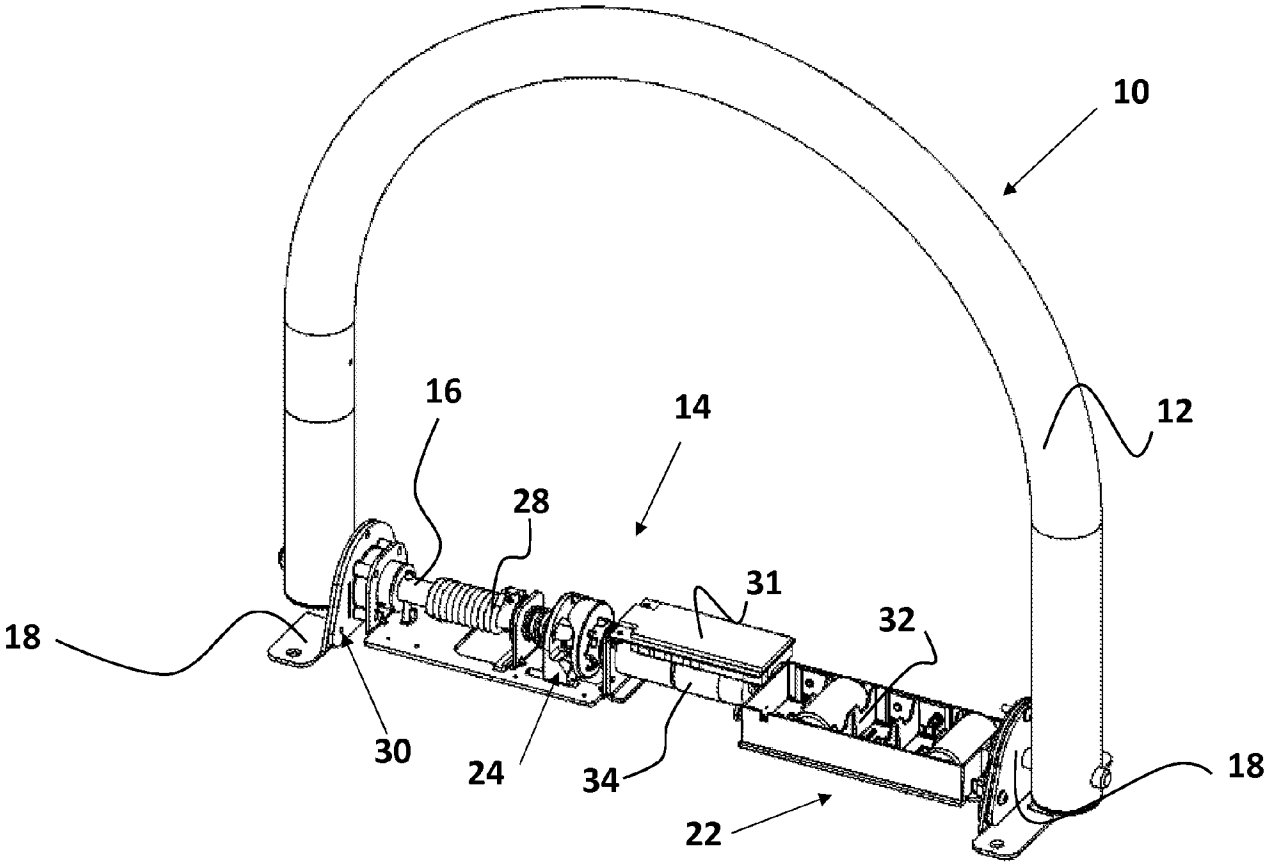
FIG. 2 shows a partially cut-away perspective view of active components of a parking barrier according to the disclosed technology.

Reference is now made to FIG. 2, which shows a partially cut-away perspective view of active components of parking barrier 10 according to the disclosed technology. As seen in FIG. 2, housing 20 of base 14 has been removed, exposing internal mechanical components disposed within the base 14, including a power source 22, a driving assembly 24 connected to rotatable shaft 16, a spring 28 mounted onto shaft 16, and a defense assembly 30, functionally associated with shaft 16. A printed circuit board (PCB) assembly 31, including circuitry for moving the arch 12 between the blocking position and the open position, is electrically connected to the driving assembly 24 and triggers operation thereof. In some embodiments, PCB assembly 31 is mounted above a motor 34, for example by connection to a suitable bracket.

In some embodiments, power source 22 comprises a battery pack 32, which typically includes batteries providing sufficient power for operating the barrier 10. In some embodiments, the battery pack 32 includes 5 Alkaline "D" cells, together nominally providing 7.5 volts. In some embodiments, the battery pack 32 comprise rechargeable batteries, which may be recharged by placing the battery pack 32 in an external recharger while placing a second battery pack in barrier 10 for operation thereof.

In some embodiments, spring 28 provides torque that counter-balances torque generated by the weight of arch 12. The balancing of torque allows for the use of a small motor and reduces power consumption during the raising and lowering of arch 12.

Figure 3A:
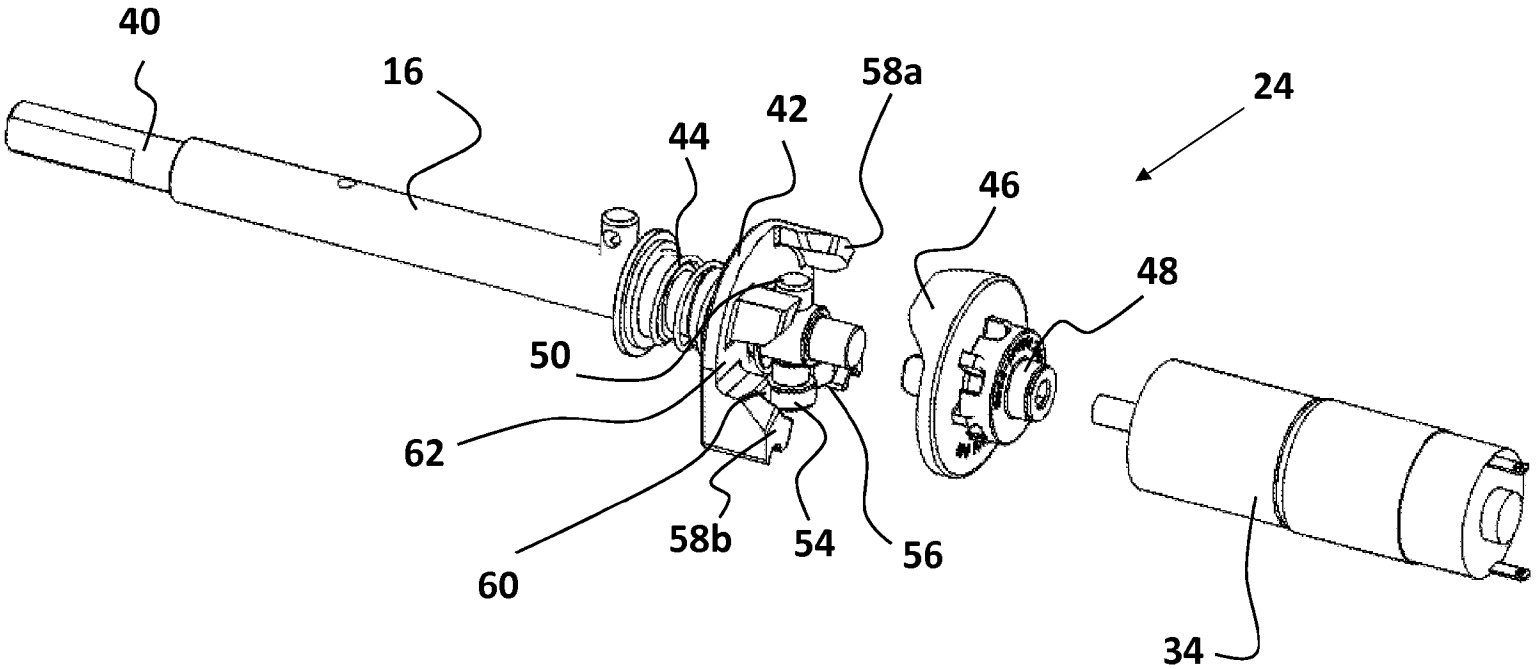
FIGS. 3A, 3B, and 3C respectively show an exploded view, a perspective view, and a side plan view of a driving assembly for driving a barrier according to the disclosed technology.
Figure 3B:
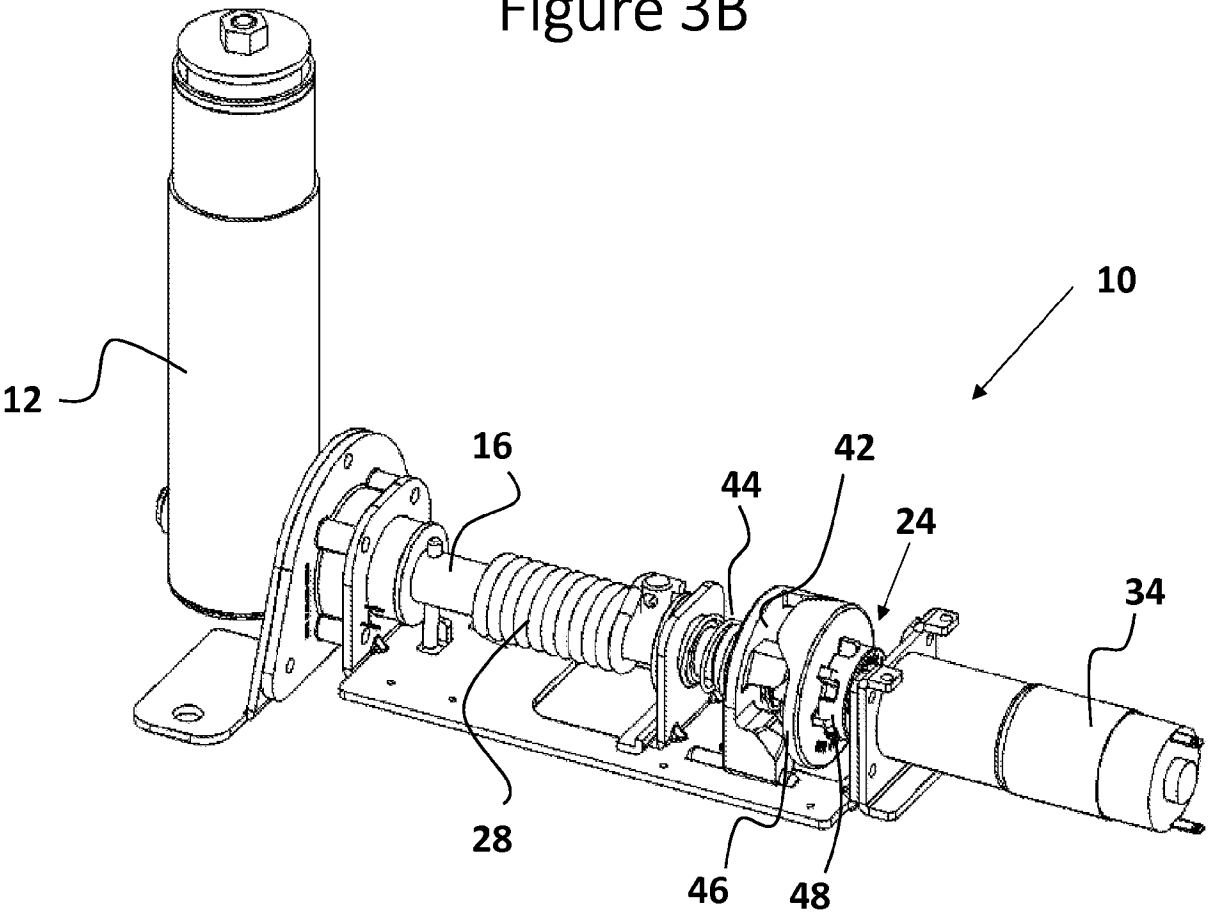
Figure 3C:
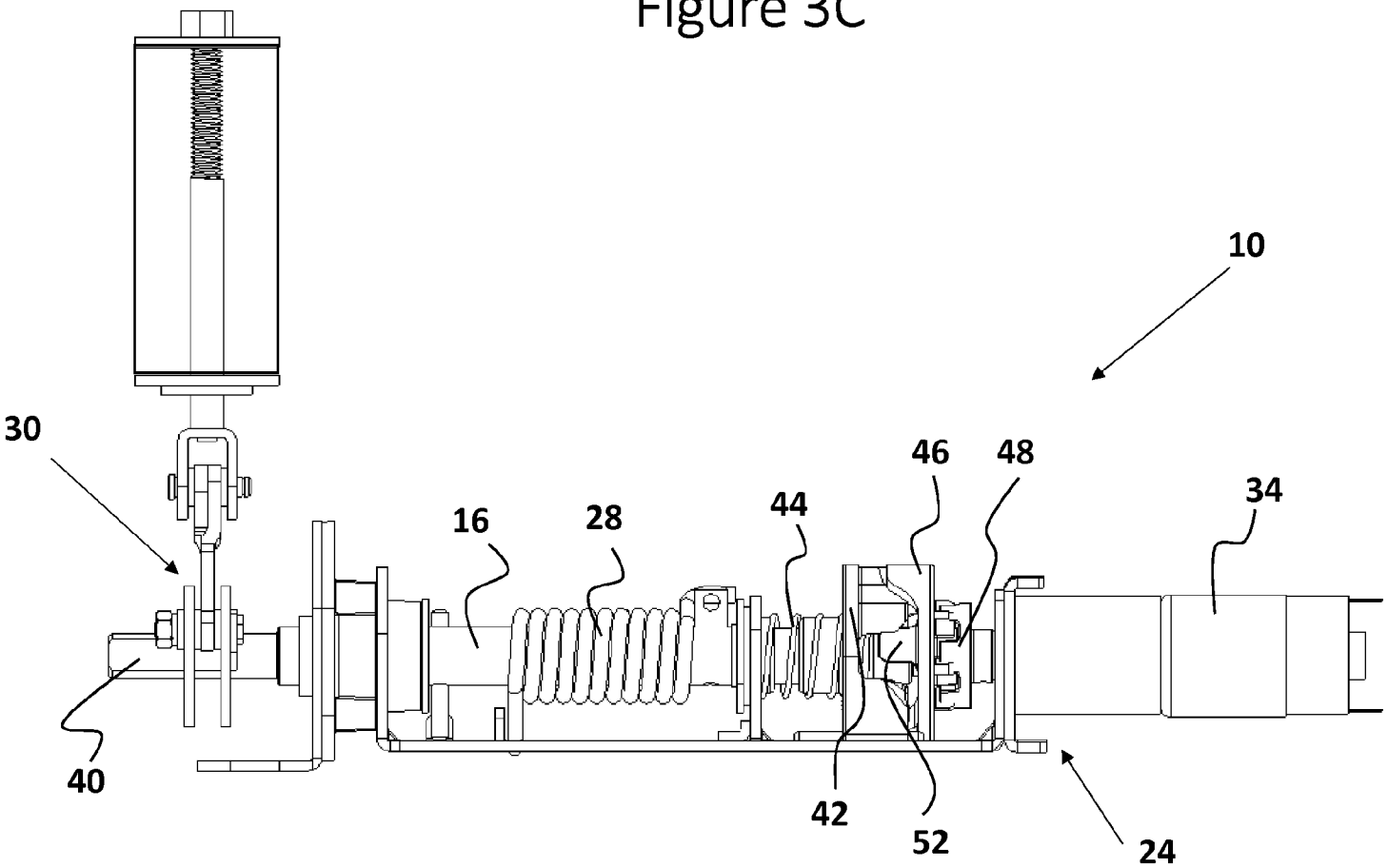

As explained in further detail herebelow with reference to FIGS. 3A to 3C, driving assembly 24 includes gear motor 34 driving rotation of shaft 16 for transition of arch 12 between the blocking position and the open position. In some embodiments, rotatable shaft 16 is connected to arch 12 at one end of the arch, while the other end of the arch 12 is hingedly connected to one of brackets 18. Rotation of shaft 16 drives rotation of the end of arch 12 connected thereto, and the other end of arch 12 rotates about the hinge due to the structural rigidity of arch 12.

Reference is now made to FIGS. 3A, 3B, and 3C, which respectively show an exploded view, a perspective view, and a side plan view of a driving assembly for driving a barrier according to the disclosed technology. As seen in FIG. 3A, rotatable shaft 16 connects to arch 12 via a keyed section 40. A brake portion 42 is slidably disposed on shaft 16, and is maintained under pressure applied by a spring 44, which pressure pushes the brake portion 42 towards a cam 46. Cam 46 is rotationally attached to gear motor 34 via a hub 48. The brake portion 42 cannot or does not rotate in embodiments of the disclosed technology. In some embodiments, motor 34, shaft 16, and brake portion 42 are aligned along a horizontal line extending between ends of arch 12, which is also the longitudinal axis of base 14.

A pin 50 extends through shaft 16 near the end thereof, close to gear motor 34. Pin 50 is configured to engage tabs 52 of cam 46 (which are seen with particular clarity in FIG. 3C), thereby to form a dog clutch that rotationally links shaft 16 with gear motor 34. It is a particular feature of the disclosed technology that tabs 52 are spaced such that cam 50 can rotate a predetermined amount, which in some embodiments is 30 degrees, without rotating shaft 16.

A cam follower 54, which engages shaft 16 and is vertically aligned with pin 50, is configured, when pushed axially under force applied by spring 44, to engage a cavity 56 in brake portion 42, thereby preventing rotation of the shaft 16. In some embodiments, when the brake portion 42 locks the shaft 16 against rotation, there is no measurable degree of freedom for rotational motion of the shaft.

In use, when brake 42 is in a locked position, cam follower 54 is nestled in cavity 56, thereby preventing rotation of shaft 16. When gear motor 34 is activated, it drives rotation of cam 46 causing surfaces of cam 46 to come into contact with facets 58*a* and 58*b* of brake portion 42, forcing the brake portion 42 axially away from motor 34 against the force of spring 44. Axial motion of brake portion 42 against the force of spring 44 frees cam follower 54 from cavity 56, so that the shaft is free to rotate under power provided by the motor 34 due to engagement of pin 50 with tabs 52 of cam 46. Thus, cam 46 only imparts motion to shaft 16 once tabs 52 engage pin 50, which may occur only after brake portion 42 has been pushed axially away from motor 34 by initial rotation of cam 46.

When the shaft 16, and correspondingly arch 12, approach a point of end of rotation, cam 46 continues to rotate, together with shaft 16, with respect to brake portion 42, and moves away from facets 58*a* and 58*b* of brake portion 42. As such, brake portion 42 is free to move axially towards motor 34 under the force of spring 44. However, at this stage cam follower 54 engages a facet 60 of brake portion 42, for a certain angular rotation of the shaft 16, which in some embodiments is approximately 30 degrees of rotation. At the end of travel, when the shaft has rotated 90 degrees, cam follower 54 disengages from facet 60 and falls into a second cavity 62 as the brake portion 42 is pushed towards motor 34 under force applied by spring 44. This position of the brake coincides with a horizontal, or fully open, position of arch 12. The end of travel when moving arch 12 into the blocking position is set by a mechanical stop on the base 14 that blocks pin 50 from further rotation. The end of travel in the open position occurs when the barrier hits the ground.

The transition of arch 12 from the horizontal open position to the vertical blocking position take place generally as described hereinabove with respect to opening arch 12, in reverse order.

It is a particular feature of the teachings herein that brake portion 42 moves between the locking position and the unlocking position thereof regardless of the direction of rotation of motor 34.

Figure 4A:
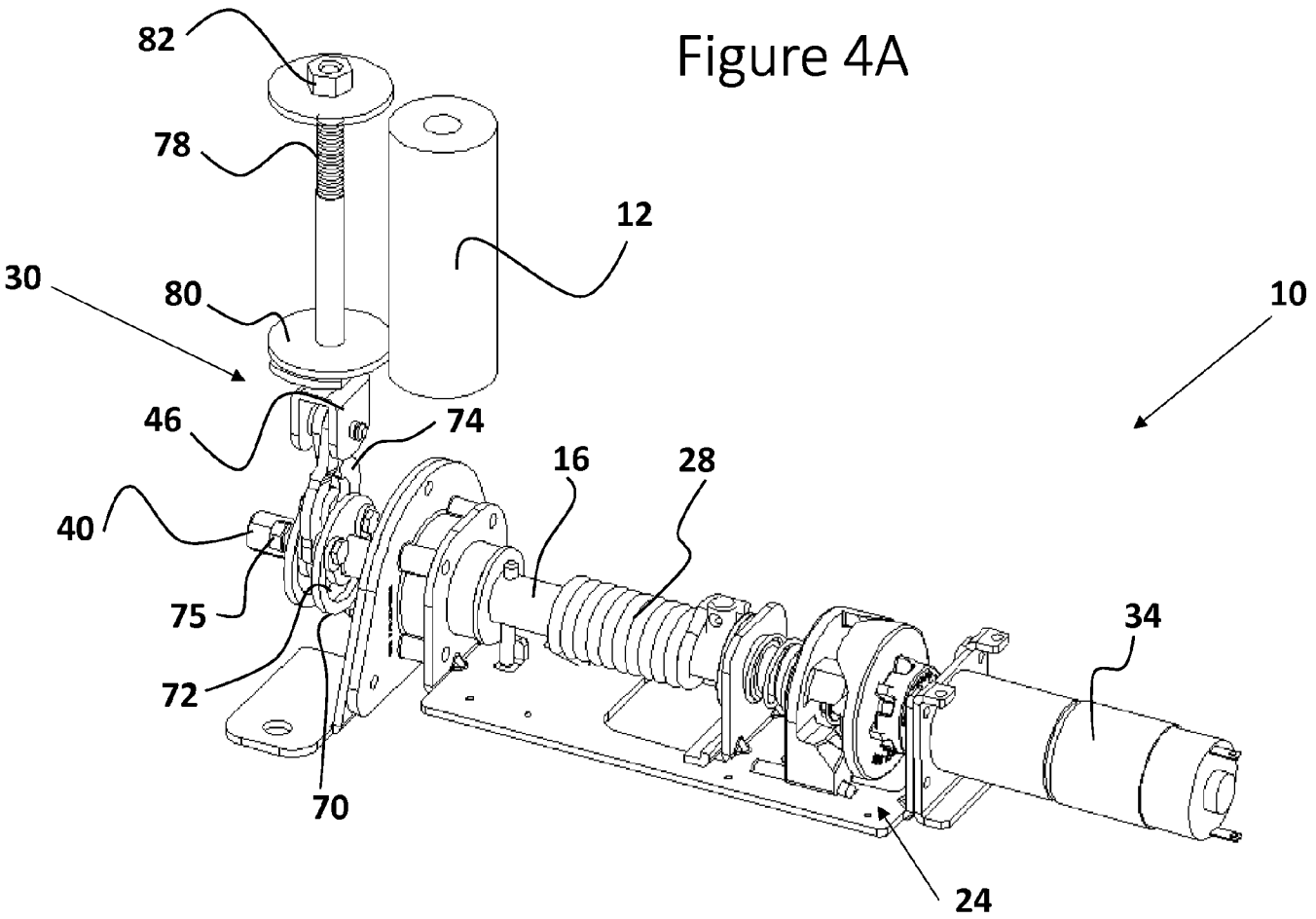
FIGS. 4A and 4B show a perspective view and a partially cut-away view of a defense assembly forming part of a barrier according to the disclosed technology.
Figure 4B:
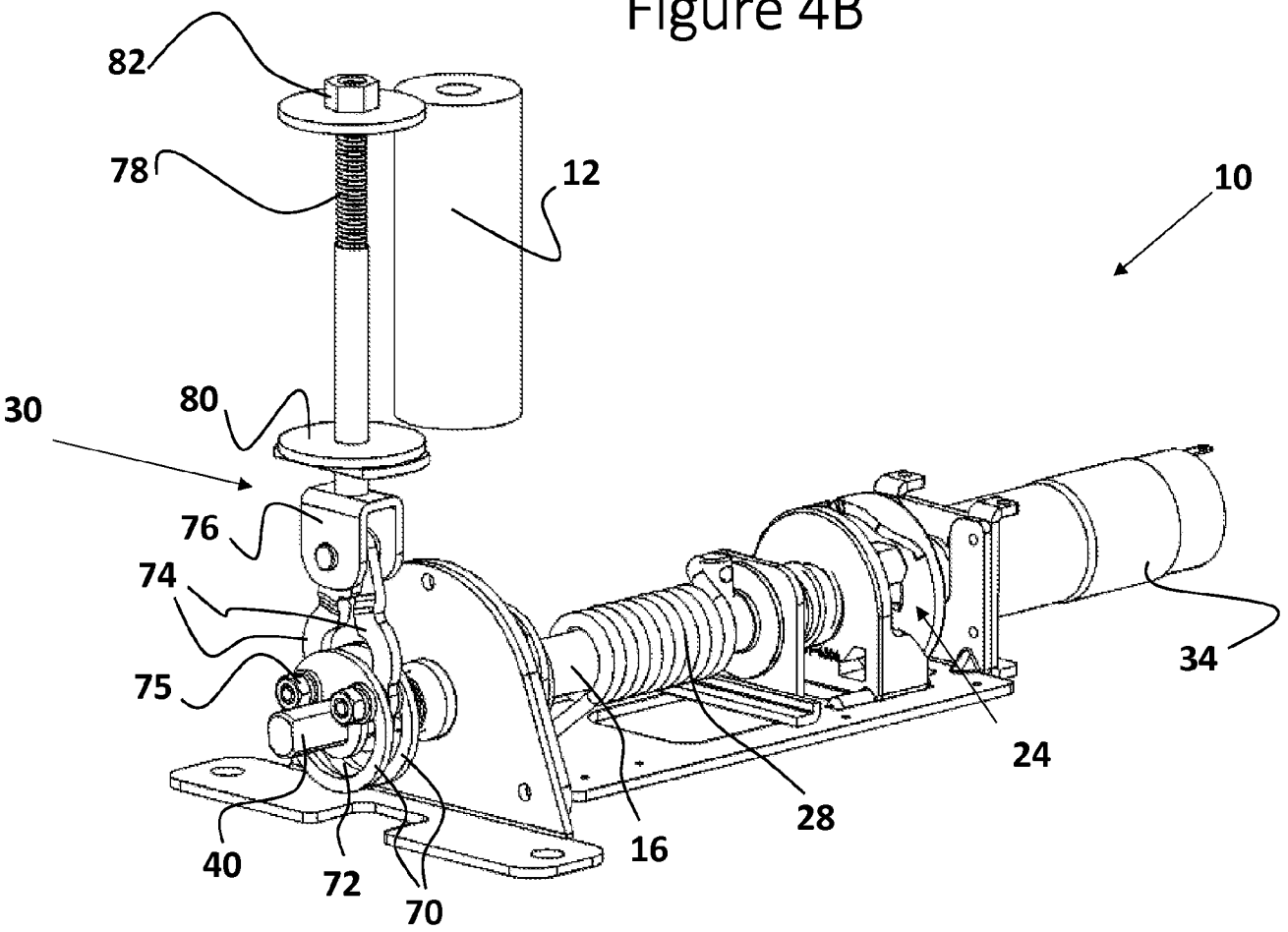

Reference is now made to FIGS. 4A and 4B, which show a perspective view and a partially cut-away view of defense assembly 30 forming part of barrier 10 according to the disclosed technology.

Defense assembly 30 includes a pair of washers 70, each including a slot 72, disposed about keyed section 40 of shaft 16. A pair of links 74 are disposed between washers 70 and are movably attached thereto via slots 72, for example by screws 75 extending through the slots and through ends of links 74. As such, links 74 are free to move within an arc perpendicular to the shaft 16. At the other end thereof, links 74 engage a bracket 76, which in turn engages a spring 78 pulling the bracket 76 upwards. Spring 78 engages a bracket 80 connected to a portion of arch 12, such that the spring extends through the portion of arch 12 and terminates in a nut 82. Tightening of nut 82 causes the spring 78 to compress, and thereby to pull bracket 76 and links 74 vertically in an upward direction.

In some embodiments, spring 78 is disposed within arch 12, as seen in FIG. 4A. Spring 78 may be fabricated of any suitable materials, and in some embodiments is fabricated of Polyurethane. In some embodiments, spring 78 comprises a heavy duty compression spring. In some embodiments, the spring 78 comprises a gas spring with internal damping.

As mentioned above, the links 74 are movably connected to washers 70, and are free to move within slots 72. In a normal, resting position, the links 74 are disposed at the top of slots 72, at a position in which the links 74 are closest to bracket 78, such that spring 78 is at its lowest force, or, stated differently, is in a rest position. When barrier 10 is in the blocking position such that arch 12 is vertical, if the arch 12 is forcibly moved from its vertical position, one of links 74 located in the direction of forced movement is forced downward within slots 72. Such downward movement of the link 74 generates a pulling force on bracket 76, resulting in further compression of spring 78. When the external force affecting the arch 12 is removed, the force of spring 78 will act to return links 74 to their initial, vertical position, and thus restore the barrier to its upright, blocking position.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein above are also contemplated and within the scope of the invention.

I claim:

1. A barrier, comprising:

a rotatable blocking arch, stable in a first, blocking position, and in a second, open position;

a rotatable shaft, functionally connected to said blocking arch, rotating said arch between said first and second positions;

an electric motor, functionally associated with said rotatable shaft, providing driving power to said shaft for rotation thereof;

a power source providing power to said electric motor;

a brake portion, slidably mounted on said shaft and actuated by said electric motor, said brake portion locking said shaft to external forces when said shaft is in a position corresponding to one of said blocking position and said open position of said arch; and a cam disposed on said shaft and rotatable therewith and engaging said motor, said cam transferring rotational force from said motor to said shaft.

2. The barrier of claim 1, wherein said electric motor, said shaft, and said brake portion are aligned along a horizontal line extending between ends of said arch.

3. The barrier of claim 1, wherein said brake portion locking said shaft prevents said shaft from rotating such that there is substantially no measurable degree of freedom for rotation of said shaft.

4. The barrier of claim 1, wherein at a start of rotation of said motor, corresponding rotation of said cam causes said cam to activate said brake portion by engaging at least one surface of said brake portion and pushing said brake portion into an unlocking position wherein said shaft is free to rotate under force of said motor.

5. The barrier of claim 1, wherein at a start of rotation of said motor, said motor rotates without driving corresponding rotation of said shaft.

6. The barrier of claim 1, further comprising a locking pin mounted onto said shaft, wherein when said shaft is in a position corresponding to said open position or to said blocking of said arch, said locking pin engages a cavity of said brake portion, thereby defining a locking position of said brake portion and blocking rotation of said shaft.

7. The barrier of claim 6, wherein during rotation of said shaft said brake portion is prevented from returning to said locking position by said locking pin being unaligned with said cavity of said brake portion.

8. The barrier of claim 6, wherein said brake portion moves between a locking position and an unlocking position thereof regardless of the direction of rotation of said motor.

9. A barrier, comprising:

a rotatable blocking arch, stable in a first, blocking position, and in a second, open position;

a rotatable shaft, functionally connected to said blocking arch, rotating said arch between said first and second positions;

an electric motor, functionally associated with said rotatable shaft, providing driving power to said shaft for rotation thereof;

a power source providing power to said electric motor;

a brake portion, slidably mounted on said shaft and actuated by said electric motor, said brake portion locking said shaft to external forces when said shaft is in a position corresponding to one of said blocking position and said open position of said arch; and a defense assembly including a spring and at least one link connecting said rotatable shaft to said rotatable arch, said link being free to move within an arc perpendicular to said shaft and being under pull tension from said spring, wherein movement of said link allows said arch to rotate relative to said shaft when rotational force exceeding a retaining force generated by said spring is applied to said arch from an external force.

10. The barrier of claim 9, wherein said spring is contained within said arch.

11. The barrier of claim 9, wherein said pull tension applied by said spring forces said arch to return to a pre-forced position once said external force has been removed.

12. The barrier of claim 9, wherein said defense assembly comprises two links connecting said rotatable shaft to said rotatable arch, a first of said two links being free to move within an arc perpendicular to said shaft in a first direction, and a second of said two links being free to move within an arc perpendicular to said shaft in a second direction opposite to said first direction, wherein said two links allow said arch to rotate relative to said shaft when rotational force exceeding a retaining force generated by said spring is applied to said arch from an external force in said first or in said second direction.

13. A barrier, comprising:

a rotatable blocking arch, stable in a first, blocking position, and in a second, open position;

a rotatable shaft, functionally connected to said blocking arch, rotating said arch between said first and second positions;

a defense assembly comprising a spring and at least one link connecting said rotatable shaft to said rotatable arch, said link being free to move within an arc perpendicular to said shaft and being under pull tension from said spring, wherein movement of said link allows said arch to rotate relative to said shaft when rotational force exceeding a retaining force generated by said spring is applied to said arch from an external force.

14. The barrier of claim 13, wherein said spring is contained within said arch.

15. The barrier of claim 13, wherein said pull tension applied by said spring forces said arch to return to a pre-forced position once said external force has been removed.

16. The barrier of claim 13, wherein said defense assembly comprises two links connecting said rotatable shaft to said rotatable arch, a first of said two links being free to move within an arc perpendicular to said shaft in a first direction, and a second of said two links being free to move within an arc perpendicular to said shaft in a second direction opposite to said first direction, wherein said two links allow said arch to rotate relative to said shaft when rotational force exceeding a retaining force generated by said spring is applied to said arch from an external force in said first or in said second direction.

17. The barrier of claim 13, wherein said defense assembly further comprises at least two planar discs including concentric slots mounted onto said shaft, and wherein said at least one link is movably attached to said concentric slots in said planar discs.

18. The barrier of claim 13, wherein said spring comprises a Polyurethane spring.

19. The barrier of claim 13, wherein said spring comprises a gas spring including internal damping.

* * * * *